US011142229B2

(12) United States Patent
Hausmann et al.

(10) Patent No.: US 11,142,229 B2
(45) Date of Patent: Oct. 12, 2021

(54) VEHICLE COMMUNICATION SYSTEM AND METHOD

(71) Applicant: General Electric Company, Schenectady, NY (US)

(72) Inventors: Adam Hausmann, Melbourne, FL (US); Tania Lindsley, Melbourne, FL (US); Derek K. Woo, Rockledge, FL (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 183 days.

(21) Appl. No.: 16/210,883

(22) Filed: Dec. 5, 2018

(65) Prior Publication Data

US 2020/0180665 A1 Jun. 11, 2020

(51) Int. Cl.

| | |
|---|---|
| ***B61L 3/00*** | (2006.01) |
| ***B61L 23/34*** | (2006.01) |
| ***B61L 15/00*** | (2006.01) |

(52) U.S. Cl.

CPC ..... *B61L 3/008* (2013.01); *B61L 15/0072* (2013.01); *B61L 23/34* (2013.01)

(58) Field of Classification Search

CPC ..... B61L 15/0072; B61L 23/34; B61L 3/008
See application file for complete search history.

(56) References Cited

U.S. PATENT DOCUMENTS 6,081,769 A * 6/2000 Curtis ..... B61L 1/14 246/122 R
7,027,899 B2 * 4/2006 Mindel ..... B61L 23/34 701/19

* cited by examiner

*Primary Examiner* — Rachid Bendidi
(74) *Attorney, Agent, or Firm* — Mary D. Lawlor; The Small Patent Law Group LLC

(57) ABSTRACT

A system that includes a lead locomotive in communication with one or more remote vehicles, and the lead locomotive including one or more processors configured to execute program instructions to perform functions based on the program instructions. These functions include determining a first characteristic related to the lead locomotive or the one or more remote locomotives, receiving historical data related to the first characteristic, comparing the first characteristic to the historical data to determine a change in first characteristic value, and determining a second characteristic related to the lead locomotive or the one or more remote locomotives. In response to the change in first characteristic value exceeding a threshold percentage, the one or more processors ignore the change in first characteristic value exceeding the threshold percentage based on the second characteristic.

3 Claims, 8 Drawing Sheets

VEHICLE COMMUNICATION SYSTEM AND METHOD

FIELD

The inventive subject matter described herein relates to communication systems and methods used in connection with monitoring for discontinuous vehicles within a distributed power vehicle system.

BACKGROUND

Some vehicle systems are formed from two or more vehicles that travel together along a similar route. For example, trains, or rail vehicle systems, include numerous rail vehicles coupled to one another that may be powered by a distributed power system. The distributed power system isolates generation of electricity, or tractive effort or dynamic braking at locations along the rail vehicle system, such that the rail vehicle system includes propulsion-generating vehicles, such as locomotives, with numerous non-propulsion-generating vehicles, such as box cars, tanker cars, flatbed cars, other cargo cars, box cars, or the like.

Currently, such rail vehicles operate the distributed power system under the assumption that a brake pipe extending along the length of the rail vehicle system is continuous and will provide a backup method of communication between vehicles. Therefore, in the event radio communications are not working as a result of failure, geography, interference, or the like, the brake pipe functions to vary the speed of the vehicle system. Thus, if an engineer wants to idle a remote propulsion-generating vehicle, the engineer can perform a brake pipe application which causes the remote propulsion-generating vehicle to go to idle, cut-out a brake valve, or the like. Alternatively, the engineer can also perform an emergency brake application and the emergency brake function propagates throughout the brake pipe to the remote propulsion-generating vehicle. In this manner, the brake pipe can be utilized and to reduce throttle, vary the throttle into idle, etc.

In some instances, however, the brake pipe is not continuous. This can occur when a rail vehicle system is formed from two separate lengths of connected rail vehicles that do not have a single continuous brake line extending the entire length of the vehicle system. In these instances, if radio communication fails at one propulsion-generating vehicle, one or more other propulsion-generating vehicles in the same rail vehicle system may be unable to receive a communication via the brake pipe to vary speed, idle, or brake. Instead, the remote propulsion-generating vehicle retains its last commanded throttle setting and continues in that state for a predetermined amount of time. Consequently, by not receiving an indication that a lead propulsion-generating vehicle is braking or that a remote propulsion-generating vehicle should brake, a derailment, or other event.

BRIEF DESCRIPTION

In one example of the inventive subject matter described herein, a system is provided that includes a lead locomotive in communication with one or more remote vehicles. The lead locomotive includes one or more processors configured to execute program instructions to perform program instructions to determine a first characteristic related to the lead locomotive or the one or more remote locomotives. The one or more processors also receive historical data related to the first characteristic, compare the first characteristic to the historical data to determine a change in first characteristic value, and determine a second characteristic related to the lead locomotive or the one or more remote locomotives. Responsive to the change in first characteristic value exceeding a threshold percentage, the one or more processors ignore the change in first characteristic value exceeding the threshold percentage based on the second characteristic.

In another example of the inventive subject matter described herein, a method is provided that includes determining one or more of moving speeds, locations, headings, or lengths of each of different segments of a rail vehicle system formed from one or more vehicles in each of the different segments of the rail vehicle system, and determining whether a difference between the one or more moving speeds, locations, headings, or lengths of two or more of the different segments of the rail vehicle system indicate that the two or more different segments of the rail vehicle system are no longer coupled with each other. The method alos includes slowing or stopping movement of at least one of the different segments of the rail vehicle system responsive to determining that the two or more different segments are no longer coupled with each other.

In another example of the inventive subject matter described herein, a method is provided that includes a. receiving historical data related to a distributed power vehicle system including first track segment data and distance between a lead propulsion-generating vehicle and a remote propulsion-generating vehicle of the distributed power vehicle system; b. receiving or determining position data of the lead propulsion-generating vehicle and the remote propulsion-generating vehicle; c. calculating a distance between the lead propulsion-generating vehicle and remote propulsion-generating vehicle based on the position data of the lead propulsion-generating vehicle, the location data of the remote propulsion-generating vehicle, and the historical data related to the first track segment; and d. determining a percentage of change between the calculated distance between the lead propulsion-generating vehicle and remote propulsion-generating vehicle and the distance between the lead propulsion-generating vehicle and remote propulsion-generating vehicle of the historical data.

BRIEF DESCRIPTION OF THE DRAWINGS

Reference is now made briefly to the accompanying drawings, in which.

DETAILED DESCRIPTION

Figure 1:
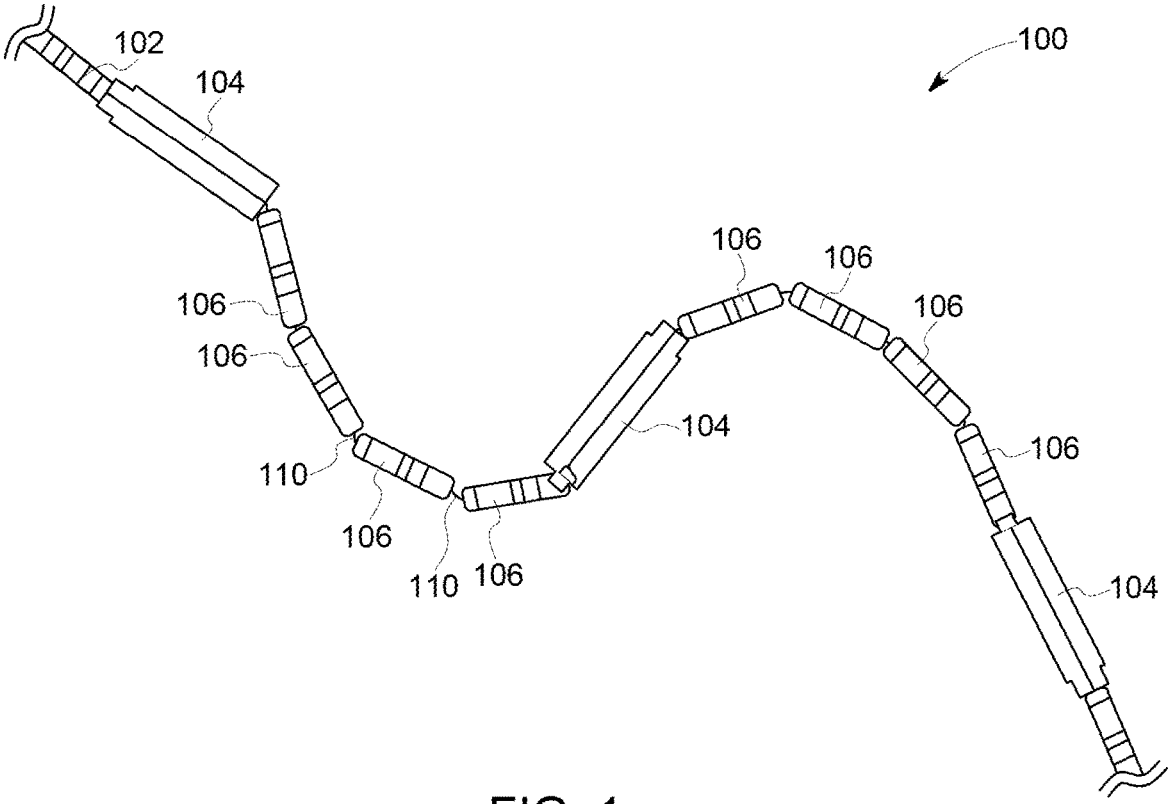
FIG. 1 is a schematic diagram of a vehicle system traveling along a route in accordance with one embodiment of the inventive subject matter.

The foregoing summary, as well as the following detailed description of various embodiments, will be better understood when read in conjunction with the appended drawings. To the extent that the figures illustrate diagrams of the functional blocks of the various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like) or multiple pieces of hardware. Similarly, the programs may be stand-alone programs, may be incorporated as subroutines in an operating system, may be functions in an installed software package, and the like. It should be understood that the various embodiments are not limited to the arrangements and instrumentality shown in the drawings.

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Provided generally are communication systems and methods used to monitor a distributed power vehicle system. The vehicle system can be a rail vehicle system formed from several propulsion-generating vehicles (e.g., locomotives) and optionally one or more non-propulsion-generating vehicles (e.g., rail cars, passenger cars, other cargo cars, etc.) that are mechanically coupled with each other to travel along routes. Optionally, the vehicle system can be another type of vehicle system, such as one formed from automobiles, trucks (and optionally trailers), marine vessels, aircraft, mining vehicles, other off-highway vehicles (e.g., vehicles that are not designed for travel on public roadways and/or that are not legally permitted for travel on public roadways). The vehicles in a vehicle system are mechanically coupled with each other in one embodiment. For example, the vehicles may be connected by couplers for travel along the routes. Alternatively, two or more (or all) of the vehicles in a vehicle system may travel together but not be mechanically coupled with each other. For example, locomotives (that optionally are coupled with rail cars) may be separate from each other but follow each other closely (e.g., within the length of a single locomotive from each other) and communicate with each other to coordinate movements so that the separate locomotives travel together as a convoy along the routes. As another example, automobiles, trucks, etc. (that optionally are coupled with trailers) may be separate from each other but follow each other closely (e.g., within the length of a trailer from each other) and communicate with each other to coordinate movements so that the separate automobiles, trucks, etc., travel together as a convoy along the routes. This type of vehicle system may involve the vehicles being logically, but not mechanically, coupled with each other as the vehicles communicate with each other to coordinate their movements.

Characteristics related to a lead propulsion-generating rail vehicle of a distributed power vehicle system and remote propulsion-generating rail vehicles can be repeatedly monitored. The lead vehicle may be located at or near a leading end of the vehicle system or may be in another location of the vehicle system. The term "lead" can refer to the vehicle that controls or dictates movements of other vehicles in the same vehicle system (e.g., the remote vehicle), but not necessarily the location of the vehicle in the rail vehicle system. The lead vehicle can be located at the front, back, or another location in the rail vehicle system. Based on the characteristics of the lead propulsion-generating rail vehicle and the remote propulsion-generating rail vehicles, characteristic values and changes in characteristic values are able to be measured, determined, calculated, and the like. In response to finding the characteristic values and/or changes in characteristic values, the communication system slows or stops movement of at least one of the different segments of the rail vehicle system responsive to determining that the two or more different segments are no longer coupled with each other.

FIG. 1 is a schematic diagram of a vehicle system 100 traveling along a route 102 in accordance with one embodiment of the inventive subject matter. The vehicle system 100 includes several propulsion-generating rail vehicles 104 and several non-propulsion-generating rail vehicles 106 mechanically interconnected with each other such that the vehicles 104, 106 travel together as a unit. The vehicles 104, 106 may be connected with each other by coupler devices 110. The terms "propulsion-generating" and "non-propulsion-generating" indicate the capability of the different vehicles 104, 106 to self-propel. For example, the propulsion-generating rail vehicles 104 represent vehicles that are capable of self-propulsion (e.g., that include motors that generate tractive effort). The non-propulsion-generating rail vehicles 106 represent vehicles that are incapable of self-propulsion (e.g., do not include motors that generate tractive effort), but may otherwise receive or use electric current for one or more purposes other than propulsion. In the illustrated embodiment, the propulsion-generating rail vehicles 104 are locomotives and the non-propulsion-generating rail vehicles 106 are non-locomotive rail cars linked together in a train. (Examples of non-propulsion-generating rail vehicles include box cars, tanker cars, flatbed cars, and other cargo cars, and certain types of passenger cars.) Alternatively, the vehicle system 100, propulsion-generating rail vehicles 104, and/or non-propulsion-generating rail vehicles 106 may represent another type of rail vehicle, another type of off-highway vehicle, automobiles, and the like. The route 102 may represent a track, road, and the like.

In one embodiment, the vehicle system 100 operates in a distributed power (DP) arrangement, where at least one propulsion-generating unit 104 is designated as a lead unit that controls or dictates operational settings (e.g., brake settings and/or throttle settings) of other propulsion-generating units (e.g., trailing propulsion-generating units 104) in the vehicle system 100. The propulsion-generating units 104 may communicate with each other to coordinate the operational settings according to the commands of the leading propulsion-generating unit 104 through one or more communication links, such as a wireless radio communication link, an electronically controlled pneumatic (ECP) brake line, multiple unit (MU) cable, and the like.

Figure 2:
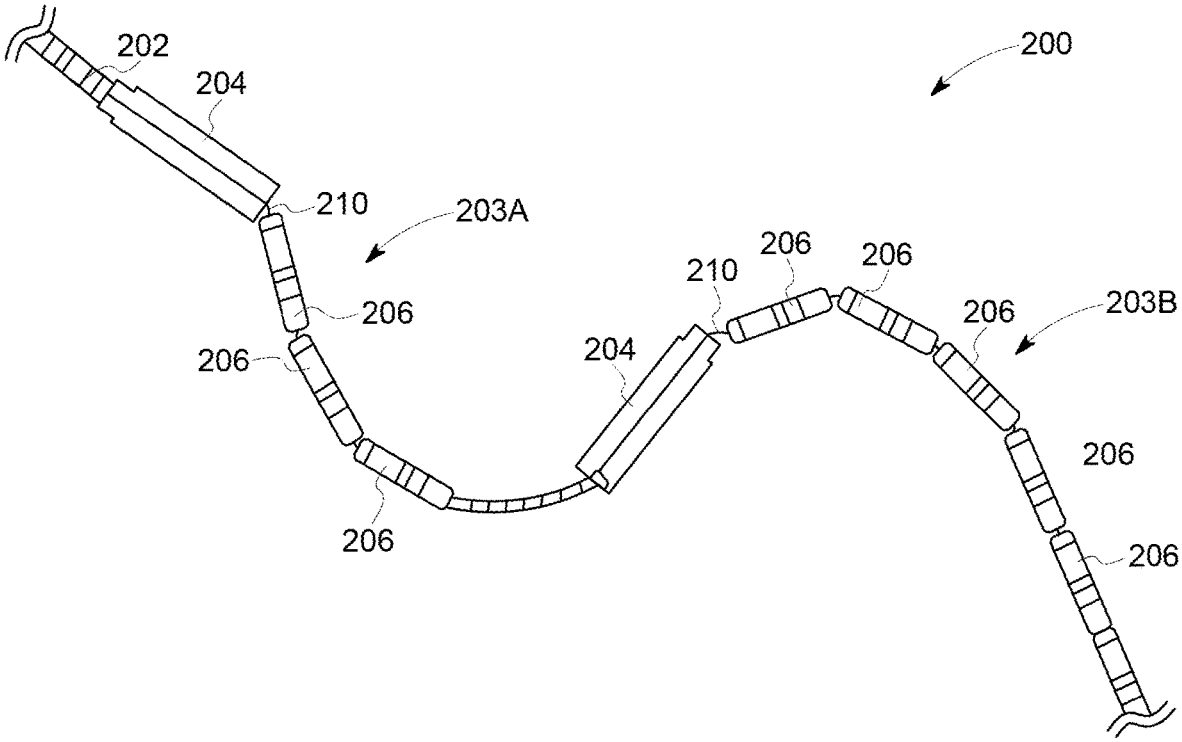
FIG. 2 is a schematic diagram of a vehicle system traveling along a route in accordance with one embodiment of the inventive subject matter.

FIG. 2 is a schematic diagram of a vehicle system 200 traveling along a route 202 in accordance with one embodiment of the inventive subject matter where the vehicle system is discontinuous. The vehicle system 200 includes two vehicle segments 203A and 203B that both include at least one propulsion-generating rail vehicle 204 and several non-propulsion-generating rail vehicles 206. Within each vehicle segment 203A and 203B, the propulsion-generating rail vehicles 204 and non-propulsion-generating rail vehicles 206 are mechanically interconnected with each other such that the vehicles 204, 206 of each segment 203A, 203B travel together as a unit. The vehicles 204, 206 may be connected with each other by coupler devices 210. While in this example the two vehicle segments 203A and 203B are physically separate, the sperate segments 203A and 203B are logically coupled utilizing a single communication and control system. In the illustrated embodiment, the propulsion-generating rail vehicles 204 are locomotives and the non-propulsion-generating rail vehicles 206 are non-locomotive rail cars linked together in a train. (Examples of non-propulsion-generating rail vehicles include box cars, tanker cars, flatbed cars, and other cargo cars, and certain types of passenger cars.) Alternatively, the vehicle system 200, propulsion-generating rail vehicles 204, and/or non-propulsion-generating rail vehicles 206 may represent another type of rail vehicle, another type of off-highway vehicle, automobiles, and the like. The route 202 may represent a track, road, and the like.

In one embodiment, the vehicle system 200 operates in a distributed power (DP) arrangement, where at least one propulsion-generating unit 204 is designated as a lead unit that controls or dictates operational settings (e.g., brake settings and/or throttle settings) of other propulsion-generating units (e.g., trailing or remote propulsion-generating units 204) in the vehicle system 200. The propulsion-generating units 204 may communicate with each other to coordinate the operational settings according to the commands of the leading propulsion-generating unit 204 through one or more communication links, such as a wireless radio communication link, an electronically controlled pneumatic (ECP) brake line, multiple unit (MU) cable, and the like.

Figure 3:
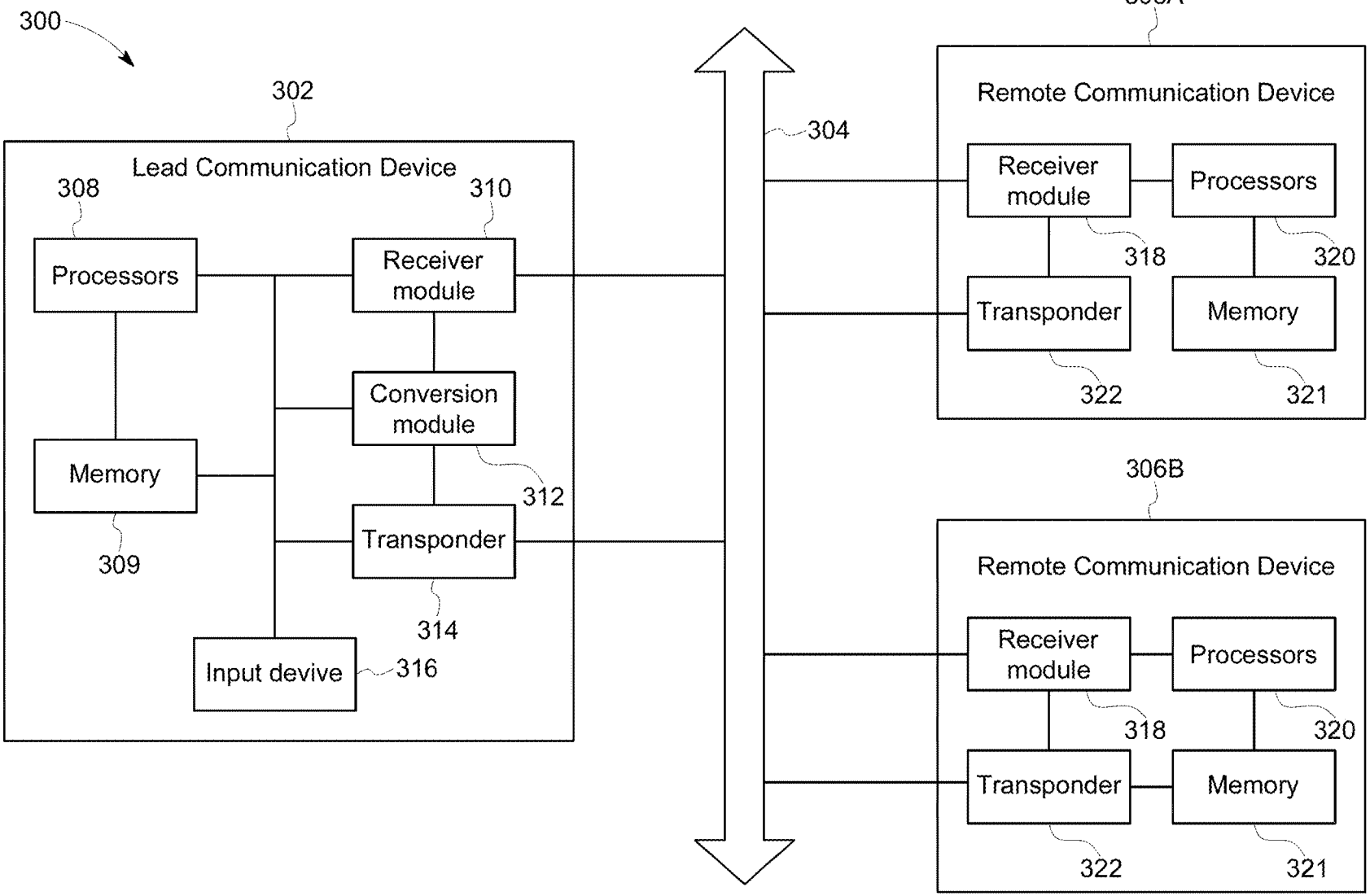
FIG. 3 is a block diagram of a communication system in accordance with one embodiment of the inventive subject matter.

FIG. 3 illustrates a block diagram of a communication system 300 in accordance with one embodiment. The communication system 300 includes a lead communication device 302, a communication link 304, and a plurality of remote communication devices 306A-B.

In example embodiments, the lead communication device 302 can include ultra-high frequency (UHF) radios, very-high frequency (VHF) radios, other two-way radios, cell phones, other cellular-based communication devices, positive train control (PTC) communication devices, Wifi based communication devices, or the like. (PTC refers to systems for automatically stopping or otherwise controlling a train, if designated criteria are met, for safety purposes.) Specifically, in an example embodiment, the lead communication device 302 is on board a lead propulsion-generating rail vehicle, and thus is part of a first segment of a power distribution vehicle system. In one example the first segment is the first segment 203A of the vehicle system 200 of FIG. 2 where a first segment 203A and second segment 203B are not mechanically coupled. Alternatively, the lead communication device 302 is on board a lead propulsion-generating rail vehicle, and thus is part of a first segment of a power distribution vehicle system that is mechanically coupled to a second segment of a vehicle system as illustrated in FIG. 1.

The lead communication device 302 includes one or more processors 308, a memory 309, a receiver module, 310, a conversion module 312 for converting data such as sensor data into characteristic values, and a transponder 314. In one example, the lead communication device 302 is able to receive a communication with the receiver module 310. Such communication includes sound inputs, including an individual talking into an input device 316 of the communication device 302 such as a microphone, radio frequencies and waves, information inputted into the communication device 302 such as typed messages though the input device 316 such as a keypad, touch screen, information conveyed by a sensor, information determined by the processor 308 such as speed from sensors, or other characteristics of a vehicle, and the like. Once the communication or information is received by the processor 308 through the receiver module 310, the communication or information is converted into a communication signal by the conversion module 312 and transmitted by the transponder 314. The communication signal is of any type, including radio waves, cellular based signals, and the like that can be received by a remote communication device 306A-B.

Each remote communication device 306A-B can include a receiver module 318 that receives the communication signal and provides an output for an individual at the remote communication device 306A-B. The output may include a sound communication, text message, email, light indicator, or the like. Specifically, each remote communication device 306A-B can include one or more processors 320, a memory 321, and a transponder 322 to receive the communication signal from the receiver module 318, process the information, output the information to the individual at the remote communication device 306A-B, and transmit communication signals over the communication link 304 as desired. Additionally, while the processor 320 may output information to an individual at the remote communication device 306A-B, the processor 320 may also vary operation of the remote propulsion-generating rail vehicle corresponding to the remote communication device 306A-B.

In one example embodiment, a remote communication device 306A or 306B is onboard a remote propulsion-generating rail vehicle of a distribution power vehicle system. In one example, a remote communication device 306A or 306B is on board a remote propulsion-generating rail vehicle of a second segment of a vehicle system that is not mechanically coupled to a first segment of a vehicle system. In one example, a remote communication device 306A or 306B is on board a remote propulsion-generating rail vehicle in the second segment 203B of the vehicle system 200 of FIG. 2. Alternatively, a remote communication device 306A or 306B is on board a remote propulsion-generating rail vehicle of a second segment of a vehicle system that is mechanically coupled to the first segment of the vehicle system as illustrated in the example of FIG. 1.

The one or more processors 308 of the lead communication device 302 and the one or more processors 320 of the remote communication devices 306A and 306B may each include a central processing unit (CPU) according to an embodiment. According to other embodiments, the one or more processors 308 may include other electronic components capable of carrying out processing functions, such as a digital signal processor, a field programmable gate array (FPGA), a graphics processing unit (GPU) or any other type of processor. According to other embodiments, the one or more processors 308 and/or 320 may include multiple electronic components capable of carrying out processing functions. For example, the one or more processors 308 may include two or more electronic components selected from a list of electronic components including: a CPU, a digital signal processor (DSP), a FPGA, and a GPU.

According to another embodiment, the one or more processors 308 and/or 320 may also include a complex demodulator (not shown) that demodulates radio frequency (RF) data and generates raw data. In another embodiment the demodulation can be carried out earlier in the processing chain. The one or more processors 308 may process information in real-time. For the purposes of this disclosure, the term "real-time" is defined to include a procedure that is performed without any intentional delay. Real-time frame or volume rates may vary based on the size of the region from which data is acquired and the specific parameters used during the acquisition.

Some embodiments, the one or more processors 308 and 320 may handle the processing tasks. For example, a first processor may be utilized to demodulate and decimate a RF signal while a second processor may be used to further process the GPS data prior to making a distance determination. It should be appreciated that other embodiments may use a different arrangement of processors. Or, the processing functions attributed to the one or more processor 308 may be allocated in a different manner between any number of separate processing components.

Figure 4:
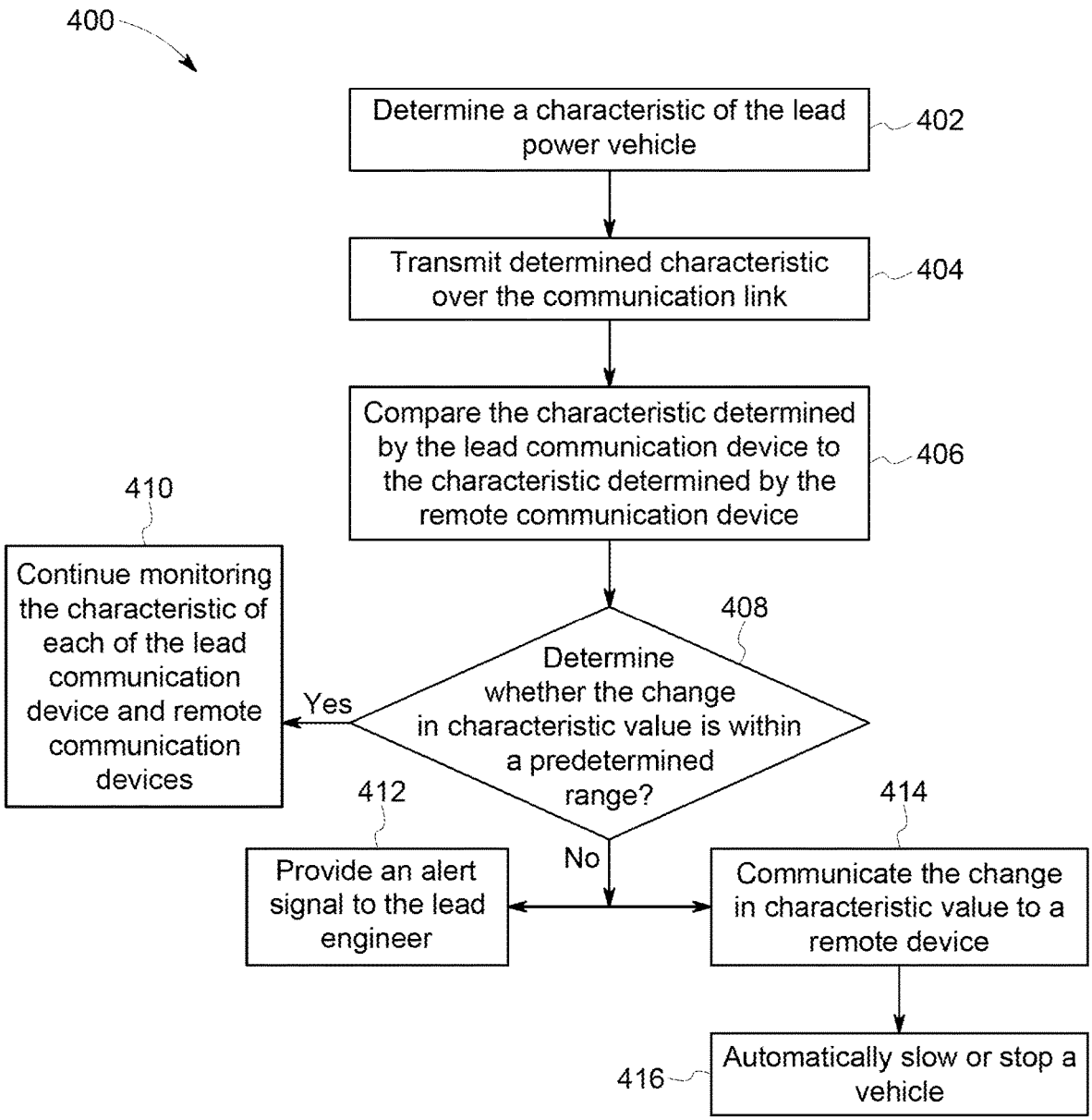
FIG. 4 is a block flow diagram of a method of monitoring a rail vehicle in accordance with one embodiment of the inventive subject matter.

FIG. 4 illustrates an example block flow diagram of a method 400 of monitoring a rail vehicle such as a train. In an exemplary embodiment, the communication system 300 is utilized to perform the method. At 402, the processor 308 of the lead communication device 302 determines a characteristic of the lead propulsion-generating rail vehicle while the processor 320 of a remote communication device 306A-B determines the characteristic of the corresponding remote propulsion-generating rail vehicle. In example embodiments, the characteristics include one or more of moving speeds, locations, headings, distances between vehicles, acceleration, throttle positions or settings, lengths, and the like of different segments of a vehicle system formed from one or more vehicles in each of the different segments of the vehicle system. Example embodiments include when each segment is mechanically coupled to at least one other segment, and where different segments are not mechanically coupled to one another and instead move as one vehicle based on a communication link between the different vehicle segments.

At 404, the determined characteristic, and in this example speed, of each remote propulsion-generating rail vehicle is then transmitted over the communication link 304 to the lead communication device 302. In one example, the remote communication devices 306A-B may receive speed data from a sensor, such as a tachometer and automatically and periodically communicate speed data to lead communication devices 302. In another example, such communication is provided at constant intervals. Alternatively, the intervals vary. In one example the intervals vary based on the geography of the track.

Specifically, in one embodiment, positioning data such as global positioning system (GPS) coordinates are utilized to calculate the speed of a train over time. When the train is traversing over a track that curves, or changes direction, the remote communication devices 306A-B may not transmit a communication signal to ensure a false reading is not detected as a result of speed changes due to a curved track. In one example embodiment, the geography of the track and the timing of the transmission of the communication signals is based on a database 324 that is remote of the lead communication device 302 and/or remote communication devices 306A-B and continually updated. Alternatively, the database 324 is stored in the memory 309 of the lead communication device 302 and/or memory 321 of the remote communication devices 306A-B and these databases are updated periodically. In example embodiments, the database 324 is a company generated database, a positive train control database, a track database, a government based database, or the like.

At 406, based on a received communication signal and based on the characteristic determined by the remote communication device 306A-B communicated from the remote communication device 306A-B, a comparison of the characteristic determined by the lead communication device 302 is made to the characteristic determined by the remote communication device 306A-B to determine a change in characteristic value indicates that two or more different segments of the vehicle system are no longer coupled to each other. In one example, a difference between the one or more moving speeds, locations, headings, distance between, or lengths of two or more of the different segments of the vehicle system are determined. The difference determined then indicates that the two or more different segments of the vehicle system are no longer coupled with each other. In one example the speed of each segment in a vehicle system is determined and as a result of a first segment moving with greater speed than a second segment, the first and second segments are indicated as no longer coupled. In yet another example speed of each segment in a vehicle system is determined and as a result of a first segment moving with less speed than a second segment, the first and second segments are indicated as no longer coupled.

Specifically, at 408, in one example, a determination is made whether the change in characteristic value is within a predetermined range. Such a determination may be made by a lead engineer, or by the lead communication device 302. At 410, if the answer is yes, the processor 308 continues to monitor the characteristic of each of the lead communication device 302 and remote communication devices 306A-B at 402. If no, at 410, upon determination that the change in characteristic value is outside of the predetermined range, the lead communication device 302 communicates the change in characteristic value to a remote device 306A-B.

In one example, the change in characteristic value is automatically communicated to the remote communication device 306A-B when the change in characteristic value is outside the predetermined range. In another example embodiment, under such a condition, the lead communication device 302 transmits an alert signal to the remote communication devices 306A-B.

In one example embodiment, the predetermined range for the change in characteristic value is ten (10) miles per hour (mph). Therefore, if the speed communicated from a remote communication device 306A-B is more than 10 mph the speed determined at the lead communication device 302, then this is communicated from the lead communication device 302 to the remote communication devices 306A-B. Similarly, if the speed communicated from a remote communication device 306A-B is less than 10 mph the speed determined at the lead communication device 302, again, this is communicated to the remote communication devices 306A-B. While in the example the range is 10 mph, in another embodiment other ranges are provided such as twenty (20) mph.

Optionally, at 412, responsive to the change in characteristic value being outside of the predetermined range, the lead communication device 302 also provides an alert signal to the lead engineer, such as a sound based alarm, a light indicator, a flashing screen, or the like to indicate a potential discontinuous train condition is presented. Optionally at 414, responsive to the change in characteristic value being outside of the predetermined range, the lead communication device 302 transmits an alert signal to one or more remote communication devices 306A-B. At 416, responsive to a determination that two or more segments of a vehicle system are no longer coupled to one another, slowing or stopping movement of at least one of the different segments of the vehicle system occurs. In one example a lead communication device 302 transmits a signal to slow or stop the movement of a lead propulsion-generating rail vehicle, while in another example a remote communication device 306A-B transmits a signal to slow or stop the movement of a remote propulsion-generating rail vehicle. In yet another example, a lead communication device 302 and remote communication devices 306A-B transmit signals to slow or stop lead propulsion-generating rail vehicle and/or remote propulsion-generating rail vehicles.

Therefore, in an example embodiment, the communication system 300 of a distributed power system has the ability to monitor speed data on both the lead propulsion-generating rail vehicle and remote propulsion-generating rail vehicles and can pass this information from the lead propulsion-generating rail vehicle to each remote propulsion-generating rail vehicle. If the speed at a remote propulsion-generating rail vehicle is significantly different, or outside a predetermined range from the lead propulsion-generating rail vehicle, an alert signal is provided to indicate a discontinuous train. To that end, the lead propulsion-generating rail vehicle can transmit an alert communication signal that a lead propulsion-generating rail vehicle has a speed that is significantly different, or outside of the predetermined range compared to the speed of the remote propulsion-generating rail vehicle, to institute an emergency application, such as braking all propulsion-generating rail vehicles to stop the train.

Figure 5:
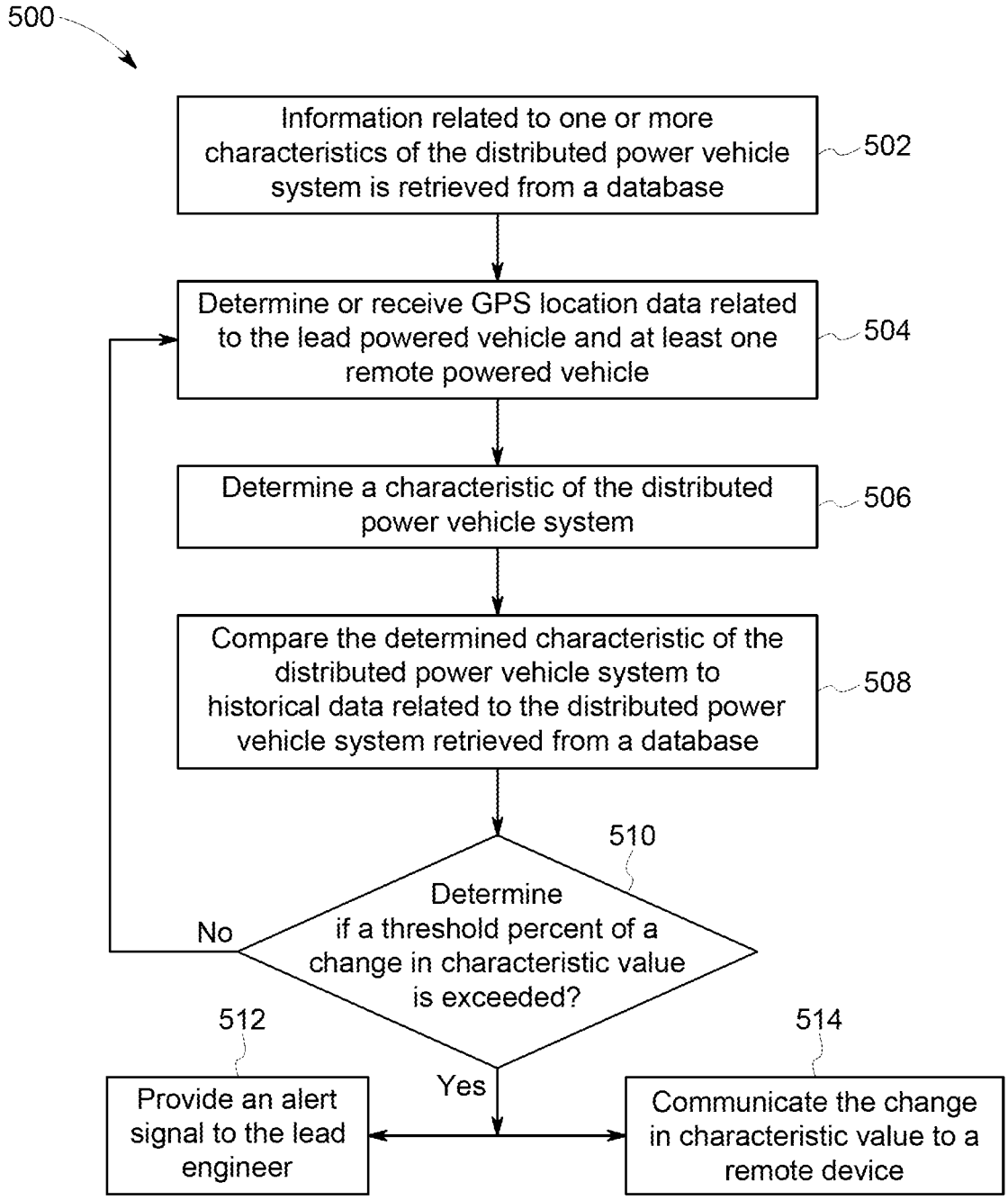
FIG. 5 is a block flow diagram of a method of monitoring a rail vehicle in accordance with one embodiment of the inventive subject matter.

FIG. 5 illustrates another exemplary block flow diagram of a method 500 of monitoring a rail vehicle such as a train. In this exemplary method, the distance between the lead propulsion-generating rail vehicle and each of the remote propulsion-generating rail vehicles of the train is continuously measured to determine if a discontinuous train is presented. Specifically, at 502, information related to one or more characteristics of the distributed power vehicle system is retrieved from a database 324. In one example embodiment the characteristic is related to historical data of the distributed power vehicle system that includes the communication system 300. The historical data includes the total distance between the lead propulsion-generating rail vehicle and each remote propulsion-generating rail vehicle, the length of the train, rail or track lengths, track curvatures, other rail or track based information, and the like. In one example embodiment, the database 324 is remote to the lead communication device 302 and/or remote communication devices 306A-B and continually updated. Alternatively, the database 324 is stored in the memory 309 of the lead communication device 302 and/or memory 309 of the remote communication devices 306A-B. In example embodiments, the database 324 is a company generated database, a positive train control database, a state based database, or the like.

At 504, the processor 308 of the lead communication device determines location data such as GPS location data related to the lead propulsion-generating rail vehicle and at least one remote propulsion-generating rail vehicle. Such information can be provided by a remote GPS, including one at a remote propulsion-generating rail vehicle, that transmits the data to the processor 308. Alternatively, data can be received by the processor 308 and the processor 308 may determine the GPS location data from the data received. Such GPS location data is received and determined at predetermined and continuous intervals. In one example embodiment, GPS positioning coordinates of the lead propulsion-generating rail vehicle and at a remote propulsion-generating rail vehicle are received by the lead communication device 302.

At 506, the processor 308 of the lead communication device determines a characteristic of the distributed power vehicle system. In one example, the GPS location data determined or received at 504 is utilized to determine the distance between the lead propulsion-generating rail vehicle and a remote propulsion-generating rail vehicle.

At 508, the processor 308 compares the determined characteristic of the distributed power vehicle system determined at 506 to historical data related to the distributed power vehicle system retrieved from a database 324 at 502 to determine a change in characteristic value of the characteristic. In one example embodiment, the distance between the lead propulsion-generating rail vehicle and the remote propulsion-generating rail vehicle determined at 506 is compared to the distance between the lead propulsion-generating rail vehicle and remote propulsion-generating rail vehicle retrieved from a database 324 to determine if the change in distance.

At 510, a determination is made based on the change in characteristic value of the characteristic whether a threshold percent of a change in characteristic value is exceeded. In one example embodiment, the threshold percentage is a 50% increase from the retrieved characteristic versus the determined characteristic. In one example, the threshold percentage decreases if the change in the characteristic value increases over a predetermined amount of iterations. Thus, in an example, if the threshold percentage is 50% and the retrieved historical data indicates a distance between a lead propulsion-generating rail vehicle and a remote propulsion-generating rail vehicle is one-hundred feet (100 ft) and during a first iteration the determined distance is a hundred and ten 110 ft, during that iteration, the change in distance value is 10 ft, thus only a 10% increase is determined and the threshold percentage is not exceeded. If the threshold percentage is not exceeded, the processor 308 of the lead communication device 302 continues to determine and receive GPS information and steps 504, 506, 508, and 510 are repeated.

If during a second consecutive iteration the determined distance is 120 ft, only a change in distance value of 20 ft is provided resulting in a 20% increase that is below the threshold percentage. If during a third consecutive iteration the distance increases again, this time to 135 ft, while the determined change in distance is only 35 ft and a 35% increase, below the threshold percentage, because this represents a third consecutive increase in distance the threshold percentage drops from 50% to 40%. Consequently, if the fourth consecutive iteration results in a determined change in distance of 45 ft, or a 45% increase, because the initial or first threshold percentage has dropped as a result of this percent change being the third consecutive increase, and because a fourth consecutive increase is provided, the subsequent or second threshold percentage is exceeded.

If the threshold percentage is exceeded, then optionally, at 512, responsive to the change in characteristic value being exceeded, or outside of the predetermined range, the lead communication device 302 provides an alert signal to the lead engineer, such as a sound based alarm, a light indicator, a flashing screen, or the like to indicate a potential discontinuous train condition is presented. Alternatively, the lead communication device automatically brakes or idles the lead propulsion-generating rail vehicle. Optionally at 514, responsive to the change in characteristic value being outside of the predetermined range, the lead communication device 302 transmits an alert signal to one or more remote communication devices 306A-B. In one example, the one or more remote communication devices receive the alert signal and in response to the alert signal the one or more remote communication devices automatically brake or idle and thus stop each section of the train corresponding to the one or more remote communication devices.

Therefore, in this manner a distributed power system can utilize databases such as a positive train control database to receive or determine the distance between a lead propulsion-generating rail vehicle and remote propulsion-generating rail vehicles on a route. Throughout the train run, the communication system 300 can monitor GPS data at the lead propulsion-generating rail vehicle and remote propulsion-generating rail vehicles to determine if a distance between the lead propulsion-generating rail vehicle and a remote propulsion-generating rail vehicle is increasing over a threshold distance. If the distance increases above the threshold, the lead communication device 302 and remote communication devices 306A-B take action to alert of a discontinuous train, or stop the train. Buy utilizing a threshold distance, the method 500 ensures errors in measurements caused by interference, geography, curved tracks, and the like do not cause a false indication of a discontinuous train.

Figure 6:
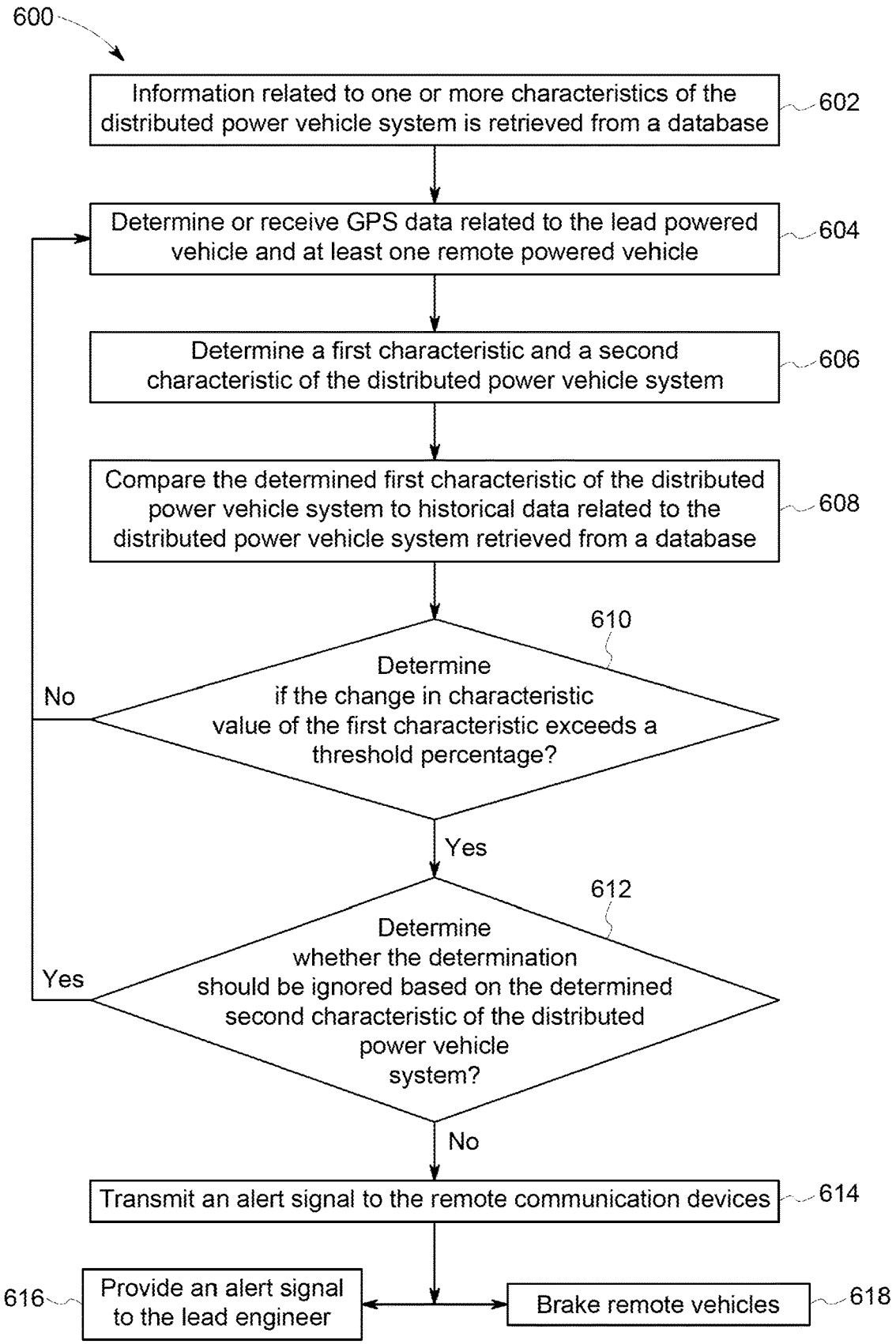
FIG. 6 is a block flow diagram of a method of monitoring a rail vehicle in accordance with one embodiment of the inventive subject matter.

FIG. 6 illustrates another exemplary block flow diagram of a method 600 of monitoring a rail vehicle such as a train. In this exemplary method, the distance between the lead propulsion-generating rail vehicle and each of the remote propulsion-generating rail vehicles of the train and heading is continuously measured to determine if a discontinuous train is presented. The heading can include directional information including north, west, east, and south based information, and can include degrees in each such direction.

Specifically, at 602, information related to one or more characteristics of the distributed power vehicle system is retrieved from a database 324. In one example embodiment the characteristic is related to historical data of the distributed power vehicle system that includes the communication system 300. The historical data includes the total distance between a lead communication device in a lead propulsion-generating rail vehicle and each remote communication device in remote propulsion-generating rail vehicles, the length of the train, rail or track lengths, track curvatures, other rail or track based information, and the like. In one example this includes a layout of a route on which the vehicle system is traveling. In one example embodiment the database 324 is remote to the lead communication device 302 and/or remote communication devices 306A-B and continually updated. Alternatively, the database 324 is stored in the memory 309 of the lead communication device 302 and/or memory 309 of the remote communication devices 306A-B. In example embodiments, the database 324 is a company generated database, a positive train control database, a state based database, or the like.

At 604, the processor 308 of the lead communication device determines or receives positioning data related to the lead propulsion-generating rail vehicle and at least one remote propulsion-generating rail vehicle. In one example, the positioning data includes GPS coordinates. Such information can be provided by a remote GPS, including one at a remote propulsion-generating rail vehicle, that transmits the data to the processor 308. Alternatively, data can be received by the processor 308 and the processor 308 may determine the GPS location data from the data received. Such positioning data is received and determined at predetermined and continuous intervals. In one example embodiment, the positing data includes heading or direction of the lead propulsion-generating rail vehicle and the remote propulsion-generating rail vehicle.

At 606, the processor 308 of the lead communication device determines a first characteristic and a second characteristic of the distributed power vehicle system. In one example, the first characteristic is the distance between the lead propulsion-generating rail vehicle and the remote propulsion-generating rail vehicle based on the GPS location data determined or received at 604. In the example the second characteristic of the distributed power vehicle system is the GPS heading of the lead propulsion-generating rail vehicle and the remote propulsion-generating rail vehicle.

At 608, the processor 308 compares the determined first characteristic of the distributed power vehicle system determined at 606 to historical data related to the distributed power vehicle system retrieved from a database 324 at 602 to determine a change in characteristic value of the characteristic. In one example embodiment, the distance between the lead propulsion-generating rail vehicle and the remote propulsion-generating rail vehicle determined at 606 is compared to the distance between the lead propulsion-generating rail vehicle and remote propulsion-generating rail vehicle retrieved from a database 324 to determine if the change in distance.

At 610, a determination is made if the change in characteristic value of the first characteristic at 608 exceeds a threshold percentage. In one example embodiment the threshold percentage is a 30% change in distance between the lead propulsion-generating rail vehicle and the remote propulsion-generating rail vehicle. If the threshold percentage is not exceeded, the processor 308 of the lead communication device 302 continues to determine and receive positioning data and steps 604, 606, 608, and 610, are repeated.

If a determination is made at 610 that the threshold percentage is exceeded, then at 612, a determination is made regarding whether the determination should be ignored based on the determined second characteristic of the distributed power vehicle system. In one example the heading of the positioning data of the lead propulsion-generating rail vehicle and each remote propulsion-generating rail vehicle is analyzed in associating with route layout data. Specifically, the heading is analyzed to determine variance between the heading of the lead propulsion-generating rail vehicle and the heading of the remote propulsion-generating rail vehicle in relation to orientations of the layout of the route on which the vehicle system is traveling. From the determination related to the heading indicates whether one or more of the segments of a rail vehicle are one the desired route or not, and thus whether the different segments remain coupled.

Specifically, if the headings of the lead propulsion-generating rail vehicle and remote propulsion-generating rail vehicle vary a predetermined amount of degrees, then an assumption is made that that the train is going around a curve and that is why the distance between the lead propulsion-generating rail vehicle and remote propulsion-generating rail vehicles vary. Thus, the determination that the percent change in distance value of the train exceeds a threshold value is ignored, and no alert signal is sent from the lead communication device 302 to the remote communication devices 306A-B. Then, the processor 308 of the lead communication device 302 continues to determine the position data and steps 604, 606, 608, and 610, are repeated. By utilizing more than one characteristic, in this case determined distance between the lead propulsion-generating rail vehicle and remote propulsion-generating rail vehicles, and heading of each propulsion-generating rail vehicle, a false determination of a discontinuous train may be detected, preventing unneeded actions being undertaken. While described in relation to a lead propulsion-generating rail vehicle and remote propulsion-generating rail vehicle, the distances between two separate remote propulsion-generating rail vehicles and GPS headings could similarly be utilized to ignore a determination that a threshold percentage has been exceeded.

If at 612 a determination is made that the determination at 610 should not be ignored based on the determined second characteristic of the distributed power vehicle system, at 614, the lead communication device 302 transmits an alert signal to the remote communication devices 306A-B. In one example embodiment, the GPS headings do not vary a predetermined amount of degrees, and the assumption is made a discontinuous train exists.

In one example embodiment, optionally, at 616, the alert signal causes an alert to occur for a lead engineer such as a light indicator, a flashing screen, or the like to indicate a potential discontinuous train condition is presented. Alternatively, in response to the alert signal, optionally, at 618, the alert signal sent to all other remote communications devices 306A-B results in each remote communication device 306A-B automatically braking and thus stopping each section of the train.

Therefore, in this manner a distributed power system can utilize databases such as a positive train control database to receive or determine the distance between a lead propulsion-generating rail vehicle and remote propulsion-generating rail vehicles on a route. Throughout the train run, the communication system 300 can monitor GPS data at the lead propulsion-generating rail vehicle and remote propulsion-generating rail vehicles to determine if the distance between the lead propulsion-generating rail vehicle and remote propulsion-generating rail vehicle is increasing over a threshold percentage change in distance value. If the percentage increases above the threshold, and a determination is made the variance is not due to a curving track determined by utilizing GPS heading data, the lead communication device 302 and remote communication devices 306A-B automatically take action to alert of a discontinuous train or stop the train.

Figure 7:
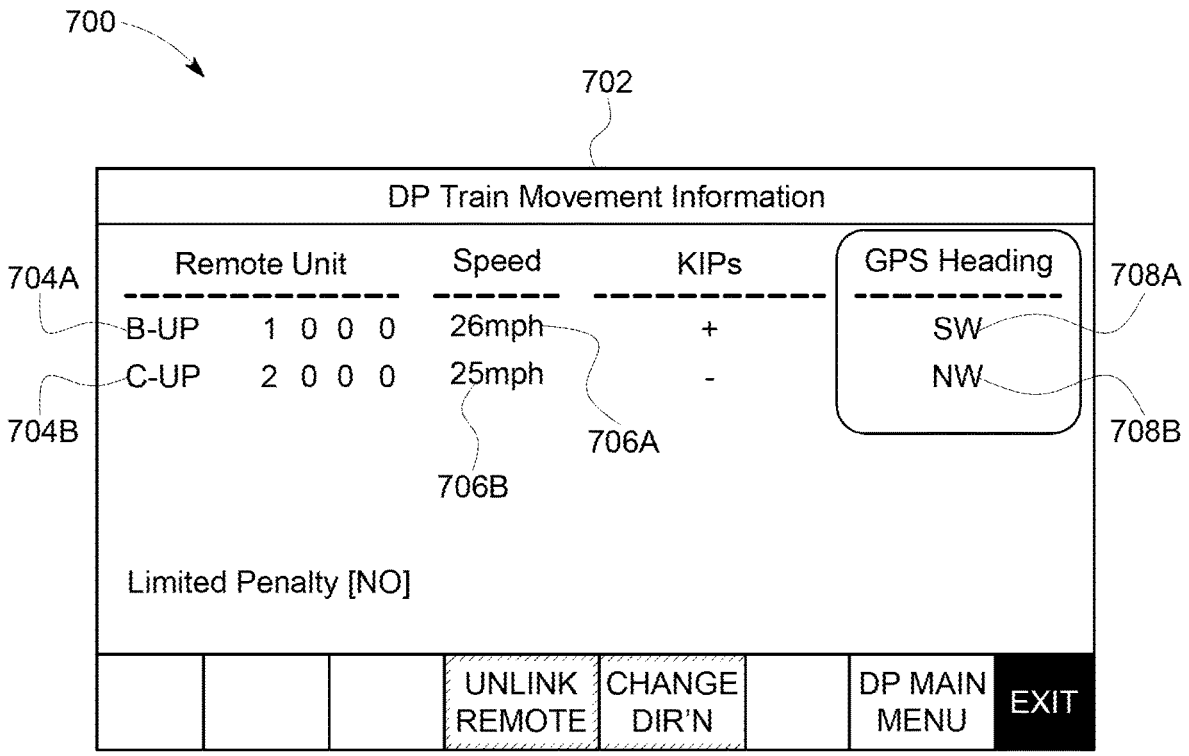
FIG. 7 is a schematic diagram of an output device of a communication system in accordance with one embodiment of the inventive subject matter.

FIG. 7 illustrates an example output device 700 that provides characteristics 702 of a lead propulsion-generating rail vehicle and remote propulsion-generating rail vehicles. In one example embodiment, the output device 700 is a screen of a lead communication device 302 as described in relation to FIG. 3. In one example embodiment the output device 700 is a screen of a lead communication device 302. In this example embodiment, a first remote propulsion-generating rail vehicle 704A and a second remote propulsion-generating rail vehicle 704B are monitored. Also provided on the output device 700 are corresponding speeds 706A and 706B and GPS headings 708A and 708B. Thus, in this example embodiment, the characteristics of the train are speed and GPS heading. As illustrated, while the speeds 706A and 706B are nearly identical, the first heading 708A indicates the first remote propulsion-generating rail vehicle is heading south west while the second heading 708B indicates the second remote propulsion-generating rail vehicle is heading north west. Consequently, if speed at the lead propulsion-generating rail vehicle increases compared to the remote propulsion-generating rail vehicles, an engineer understands the lead propulsion-generating rail vehicle is at a straight portion of the track compared to the first remote propulsion-generating rail vehicle and second remote propulsion-generating rail vehicle that are still traveling around a curved track. Similarly, a processor 308 of the lead communication device 302 can ignore a difference in speed resulting from a train traversing a curved track.

Figure 8:
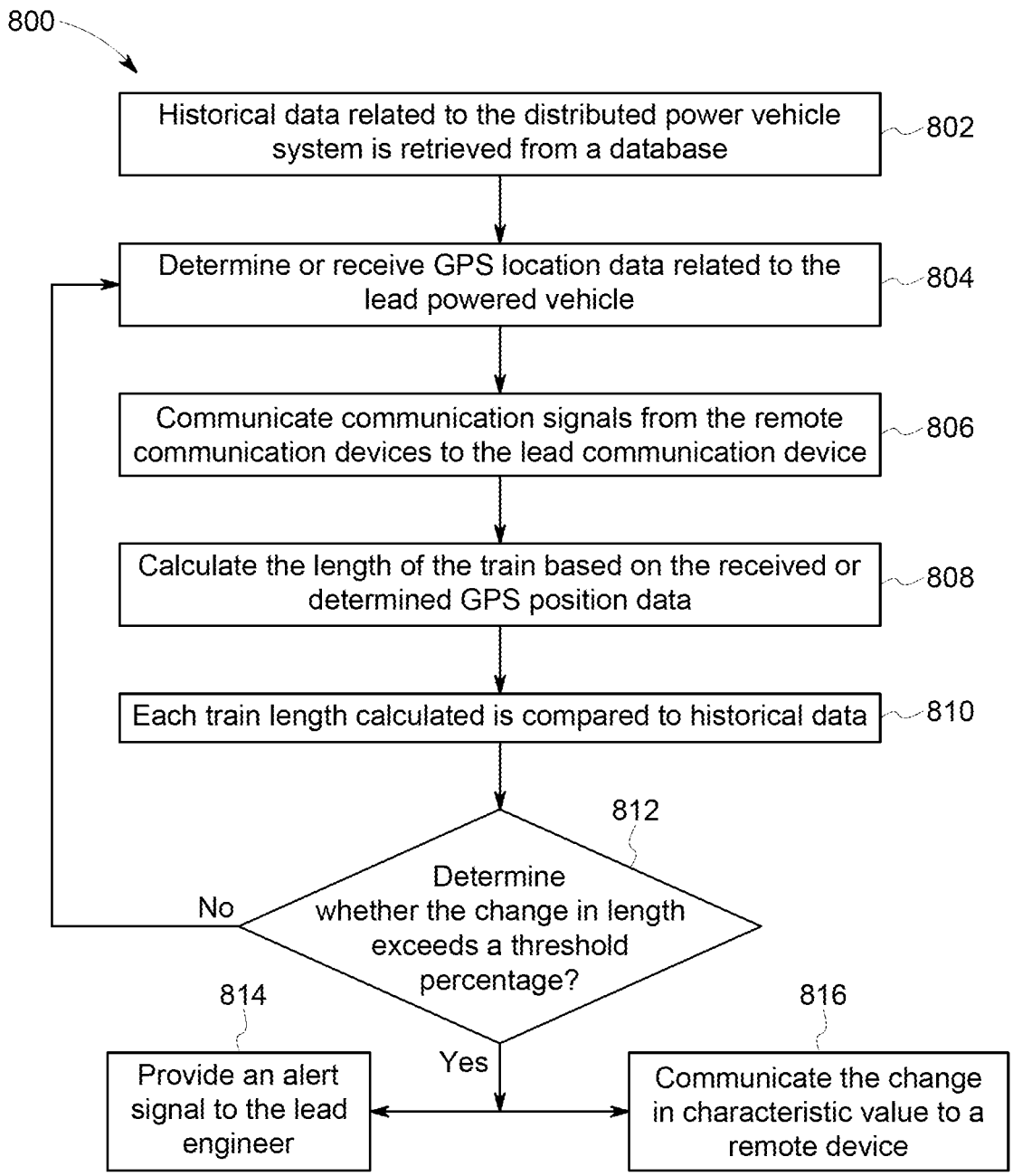
FIG. 8 is a block flow diagram of a method of monitoring a rail vehicle in accordance with one embodiment of the inventive subject matter.

FIG. 8 illustrates another exemplary block flow diagram of a method 800 of monitoring a rail vehicle such as a train. In this exemplary method, the length of the train is continuously measured to determine if a discontinuous train is presented. Specifically, at 802, historical data related to the distributed power vehicle system including information related to one or more characteristics of the train is retrieved from a database 324. In one example embodiment the characteristic is the total length of the train. In one example embodiment the database 324 is remote of the lead communication device 302 and/or remote communication devices 306A-B and continually updated. Alternatively, the database 324 is stored in the memory 309 of the lead communication device 302 and/or memory 321 of the remote communication devices 306A-B. In example embodiments, the database 324 is a company generated database, a positive train control database, a government-based database, or the like.

At 804, the processor 308 of the lead communication device determines or receives GPS location data related to the lead propulsion-generating rail vehicle. Such information can be provided by a remote GPS that transmits the data to the processor, or data can be received by the processor and the processor may determine the GPS location data from the data received. Such GPS location data is received and determined at predetermined and continuous intervals.

At 806, communication signals are communicated from the remote communication devices 306A-B to the lead communication device 302 that includes GPS location data associated with the remote communication device 306A-B sending the communication signal. Again, this GPS location data is transmitted at predetermined and continuous intervals to correspond to the GPS location data received or determined at 804.

At 808, the processor 308 of the lead communication device 302 calculates the length of the train based on the received or determined GPS position data from 804 and the corresponding transmitted GPS position data of 806. Specifically, in this example embodiment, information related to one or more characteristics of the train is retrieved from a database 324 at 802 that includes information related to the track upon which the train is traveling. Specifically, tracks of a train include curves that can cause the distance between the lead propulsion-generating rail vehicle and the remote propulsion-generating rail vehicles to vary even though the vehicles are going the same speed. However, train tracks are not permitted to be complex curves by regulation. As a result, an algorithm utilized by the processor 308 of the lead communication device 302 receives the data related to the known curves. Specifically, the known curves are able to be incrementally added up in segments and verified to provide the length of the train based on the GPS position data obtained at steps 804 and 806. While in this example embodiment the processor 308 of the lead communication device 302 makes such determinations, the processor 308 of a remote communication device 306A-B, or other remote processor could make such determinations and transmit this information to the processor 308 of the lead communication device 302.

At 810, each train length calculated at 808 is compared to a length retrieved at 802 related to the length of train. In one example, the length calculated is different than the length provided in historical data. Alternatively, the length calculated is the same as the length provided in historical data. At 812, a determination is made regarding whether the change in length exceeds a threshold percentage. In one example embodiment, the threshold percentage is a 20% increase from the retrieved length versus the determined length. In one example, the threshold percentage decreases if the length of the train is detected as increasing over a predetermined amount of iterations. Thus, in an example, if the train is determined to be increasing over four straight iterations, the threshold percentage is decreased to 20% of an increase in length. If the threshold percentage is not exceeded, the processor 308 of the lead communication device 302 continues to determine and receive GPS information and steps 804, 806, 808, 810, and 812 are repeated.

If the threshold percentage is exceeded, then at 814 the lead communication device 302 transmits an alert signal to the remote communication devices 306A-B. In one example embodiment, optionally, at 816, the alert signal causes an alert to occur for a lead engineer such as a light indicator, a flashing screen, or the like to indicate a potential discontinuous train condition is presented. Alternatively, in response to the alert signal, optionally, the alert signal sent to all other remote communications devices 306A-B results in each remote communication device 306A-B automatically braking and thus stopping each section of the train. By utilizing real-time GPS positioning data with historical track data, an algorithm can be utilized to account for curves in a track to prevent false determination of a discontinuous train.

Therefore, in this manner a distributed power system can utilize databases such as a positive train control database to receive or determine the train length on a route. Throughout the train run, the communication system 300 can in real-time monitor GPS data at the lead propulsion-generating rail vehicle and remote propulsion-generating rail vehicles to determine if the length of the vehicle is increasing over a threshold length of the train. If the length increases above the threshold, the lead communication device 302 and remote communication devices 306A-B take action to alert of a discontinuous train, or stop the train.

Figure 9:
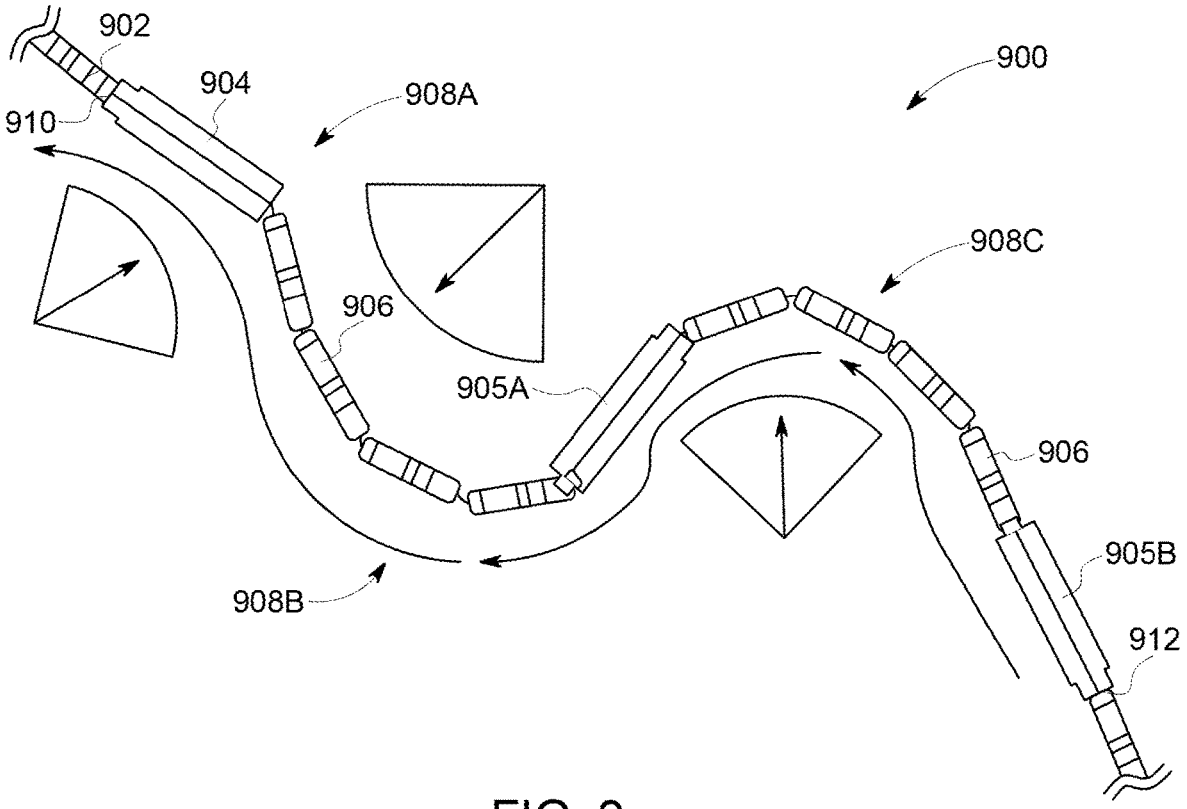
FIG. 9 is a schematic diagram of a vehicle system traveling along a curved route in accordance with one embodiment of the inventive subject matter

FIG. 9 illustrates a schematic diagram of a vehicle system 900 traveling along a curved route 902 in accordance with one embodiment of the inventive subject matter. The vehicle system 900 includes a lead propulsion-generating rail vehicle 904, a first remote propulsion-generating rail vehicle 905A, a second remote propulsion-generating rail vehicle 905B, and several non-propulsion-generating rail vehicles 906.

The route 902 includes a first curved track segment 908A, second curved track segment 908B, and third curved track segment 908C. Such curved track segments 908A, 908B, and 908C have known distances, circumference, curvature, or the like. Such information may be retrieved from a database as described in previous example methods described. Then, based on this information, the length of the train may be determined through the segments 908A, 908B, and 908C as described in the method of FIG. 8.

Therefore, numerous characteristics may be determined by a communication system, such as in one example, the communication system 300 of FIG. 3. In an example, the length of the train from a leading end 910 of the lead propulsion-generating rail vehicle 904 to the trailing end 912 of the second remote propulsion-generating rail vehicle 905B when the vehicle system is on a straight track is measured and stored in a database to be retrieved by a communication device of the vehicle system 900. Then, during operation of the vehicle, the real-time distance between the leading end 910 of the lead propulsion-generating rail vehicle 904 to the trailing end 912 of the second remote propulsion-generating rail vehicle 905B is determined using positioning data, such as GPS coordinates received by the communication devices of the vehicle system 900.

While the length in this example is from the leading end 910 of the lead propulsion-generating rail vehicle 904 to the trailing end 912 of the second remote propulsion-generating rail vehicle 904, in other examples, the length is measured from a lead communication device in the lead propulsion-generating rail vehicle to a remote communication device in a remote propulsion-generating rail vehicle 905A or 905B. Alternatively, the length is from a point of reference on a remote propulsion-generating rail vehicle 905A or 905B to another remote propulsion-generating rail vehicle 905A or 905B, or to a point of reference of a lead propulsion-generating rail vehicle 904.

Thus, provided is a communication system 300 and numerous methods utilizing the communication system 300 to improve monitoring of a rail vehicle. The communication system 300 monitors characteristics of the train and based on these characteristics, and optionally historical train or track information from a database, determines if a discontinuous train is provided. If a discontinuous train is determined, the communication system can take emergency action to control the discontinuous train.

In one example of the inventive subject matter described herein, a system (e.g., a control system, such as a train or locomotive control system) includes a lead vehicle (e.g., a lead locomotive or other lead rail vehicle, or another type of vehicle such as an on-road semi-trailer truck) in communication with one or more remote vehicles (e.g., remote locomotives or other rail vehicles, or other types of vehicles such as on-road semi-trailer trucks), and the lead vehicle includes one or more processors configured to execute program instructions to perform the program instructions. The one or more processors determine a first characteristic related to the lead vehicle or the one or more remote vehicles, and receive historical data related to the first characteristic. The one or more processors also compare the first characteristic to the historical data to determine a change in first characteristic value, and determine a second characteristic related to the lead vehicle or the one or more remote vehicles. Responsive to the change in first characteristic value exceeding a threshold percentage, the one or more processors ignore the change in first characteristic value exceeding the threshold percentage based on the second characteristic.

Optionally, the first characteristic related to the lead vehicle (e.g., the lead locomotive or other rail vehicle, or other vehicle) or the one or more remote vehicles (e.g., the remote locomotives or other rail vehicles, or other vehicles) includes a moving speed, a location, or a heading, of the lead vehicle or the one or more remote vehicles. Alternatively, the change in first characteristic value is a distance between a portion of the lead vehicle and a portion of a remote vehicle.

In one example, the historical data is received from a database that is one of a memory of a lead communication device, a memory of a remote communication device, a company generated database, a positive train control database, a track database, or a government based database. Optionally, the lead vehicle is not physically coupled to the one or more remote vehicles.

In another example, the lead locomotive including the one or more processors are further configured to execute program instructions to, responsive to the change in first characteristic value not exceeding a threshold percentage, brake the lead locomotive and the one or more remote locomotives.

In one example of the inventive subject matter described herein, a method (e.g., for train or other rail vehicle system control, or for other vehicle system control) is provided that includes determining one or more of moving speeds, locations, headings, or lengths of each of different segments of a vehicle system (e.g., a rail vehicle system) formed from one or more vehicles in each of the different segments of the vehicle system (e.g., rail vehicle system). For example, the one or more vehicles may include at least one locomotive, and/or they may include other vehicles. The method includes determining whether a difference between the one or more moving speeds, locations, headings, or lengths of two or more of the different segments of the vehicle system indicate that the two or more different segments of the vehicle system are no longer coupled with each other, and slowing or stopping movement of at least one of the different segments of the vehicle system responsive to determining that the two or more different segments are no longer coupled with each other.

Optionally, determining the one or more moving speeds, locations, headings, or lengths of the different segments of the vehicle system includes determining the moving speed of each of the two or more different segments. Alternatively, the difference between the moving speeds of the two or more different segments indicates that the two or more different segments are no longer coupled when the difference indicates that a first segment of the two or more different segments is moving faster than a second segment of the two or more different segments.

In another example, determining the one or more moving speeds, locations, headings, distance between, or lengths of the different segments of the vehicle system includes determining the locations of each of the two or more different segments, and the difference between the locations indicates that a total length of the vehicle system has increased beyond a designated total length of the vehicle system. Optionally, the designated total length of the vehicle system is a length from a leading end of the vehicle system to an opposite trailing end of the vehicle system when the different segments of the vehicle system were coupled with each other.

In another example, the one or more moving speeds, locations, headings, or lengths of the different segments of the vehicle system includes determining the headings of each of the two or more different segments, and further includes determining a layout of a route on which the vehicle system is traveling while the headings of the different segments are determined. The one or more moving speeds, locations, headings, or lengths of the different segments of the vehicle system also includes determining the difference between the headings of the different segments and orientations of the layout of the route where the different segments are to be located while the different segments remain coupled, and the difference between the headings indicates that one or more of the different segments are not located on the route if the different segments remain coupled.

Optionally, two or more different segments of the vehicle system are mechanically coupled. Alternatively, two or more different segments of the vehicle system are not mechanically coupled. In one example, the two or more of the different segments of the vehicle system includes a lead propulsion-generating vehicle (e.g., lead locomotive) in a first segment and a remote propulsion-generating vehicle (e.g., remote locomotive) in a second segment. In yet another example, the lead propulsion-generating vehicle is in communication with the remote propulsion generating vehicle.

In yet another example of the inventive subject matter described herein, a method (e.g., a method for train control, or vehicle system control more generally) is provided that includes receiving historical data related to a distributed power vehicle system (e.g., train, or on-road convoy of communicatively-linked vehicles) including first route (e.g., track) segment data and distance between a lead propulsion-generating vehicle (e.g., lead locomotive, or other lead vehicle such as a semi-trailer truck) and a remote propulsion-generating vehicle (e.g., remote locomotive, or other remote vehicle such as a semi-trailer truck) of the distributed power vehicle system, and receiving or determining position data of the lead propulsion-generating vehicle and the remote propulsion-generating vehicle. The example method also includes calculating a distance between the lead propulsion-generating vehicle and remote propulsion-generating vehicle based on the position data of the lead propulsion-generating vehicle, the location data of the remote propulsion-generating vehicle, and the historical data related to the first route segment, and determining a percentage of change between the calculated distance between the lead propulsion-generating vehicle and remote propulsion-generating vehicle and the distance between the lead propulsion-generating vehicle and remote propulsion-generating vehicle of the historical data. In one example, the method also includes repeating these steps when the percentage of change is below a threshold percentage.

Optionally, responsive to receiving the percentage of change above the threshold percentage, the remote communication device brakes the remote propulsion-generating vehicle. Alternatively, in response to receiving the percentage of change above the threshold percentage, an alert is displayed on a display screen of the lead communication device (or vehicle).

In one example, the historical data related to a distributed power vehicle system includes second track segment data. In another example the first track segment data includes first track segment curvature in degrees.

In an embodiment, a system (e.g., a system for train control, or for other vehicle control) includes a controller having one or more processors, which is configured for operable deployment on board a vehicle of a vehicle system (e.g., a rail vehicle system, or a vehicle system comprised of other vehicles, such as a platoon of communicatively linked on-road semi-trailer trucks). For example, the controller may be configured to be coupled with an electrical system of the vehicle, to run off electrical power on board the vehicle, and to communicate, e.g., controllably communicate, with one or more sub-systems (e.g., braking or throttle control) of the vehicle. The controller is configured to determine one or more of moving speeds, locations, headings, or lengths of each of different segments of the vehicle system formed from one or more vehicles in each of the different segments of the rail vehicle system. The controller is further configured to determine whether a difference between the one or more moving speeds, locations, headings, or lengths of two or more of the different segments of the vehicle system indicate that the two or more different segments of the vehicle system are no longer coupled with each other. The controller is further configured to control (e.g., slow or stop) movement of at least one of the different segments of the vehicle system responsive to determining that the two or more different segments are no longer coupled with each other.

In an embodiment, a system (e.g., a system for train control, or for other vehicle system control) includes a controller having one or more processors, which is configured for operable deployment on board a vehicle of a distributed power vehicle system (e.g., a rail vehicle system, or a vehicle system comprised of other vehicles, such as a platoon of communicatively linked on-road semi-trailer trucks, or other vehicle system where plural propulsion-generating vehicles of the vehicle system are controlled, e.g., automatically, in coordination for travel along a route). For example, the controller may be configured to be coupled with an electrical system of the vehicle, to run off electrical power on board the vehicle, and to communicate, e.g., controllably communicate, with one or more sub-systems (e.g., braking or throttle control) of the vehicle and/or other vehicles. The controller is configured to receive historical data related to the distributed power vehicle system including first route (e.g., track) segment data and distance between a lead propulsion-generating vehicle and a remote propulsion-generating vehicle of the distributed power vehicle system. The controller is further configured to receive or determine position data of the lead propulsion-generating vehicle and the remote propulsion-generating vehicle. The controller is further configured to calculate a distance between the lead propulsion-generating vehicle and remote propulsion-generating vehicle based on the position data of the lead propulsion-generating vehicle, the location data of the remote propulsion-generating vehicle, and the historical data related to the first route segment. The controller is further configured to determine a percentage of change between the calculated distance between the lead propulsion-generating vehicle and remote propulsion-generating vehicle and the distance between the lead propulsion-generating vehicle and remote propulsion-generating vehicle of the historical data. For the given calculations, the geometry of the route relative to the path of travel of the vehicle system may be known.

In any of the embodiments herein, a vehicle system may include vehicles that are mechanically linked to one another; however, one group of the vehicles may not be directly mechanically connected to another group of the vehicles, that is, the two groups are connected only by intervening vehicles. Alternatively, vehicles may be non-mechanically coupled to one another, but are instead only logically/communicatively coupled. Alternatively, one group of vehicles may be mechanically linked to one another, and another group of vehicles may be mechanically linked to one another, with the two groups not being mechanically linked in any manner. Where applicable, propulsion generating vehicles may be communicatively linked for coordinated control action, or otherwise, as set forth herein. Also, any references to a track or track segment more generally apply to routes and route segments more generally, unless otherwise specified.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A vehicle control system comprising:

a lead vehicle in communication with one or more remote vehicles;

the lead vehicle including one or more processors configured to execute program instructions to:

determine a first characteristic related to the lead vehicle or the one or more remote vehicles;

receive historical data related to the first characteristic;

compare the first characteristic to the historical data to determine a change in first characteristic value;

determine a second characteristic related to the lead vehicle or the one or more remote vehicles, the second characteristic indicative of a heading of one or more of the lead vehicle or the one or more remote vehicles; and responsive to the change in first characteristic value exceeding the threshold percentage, brake at least one of the lead vehicle or one or more of the one or more remote vehicles based on the second characteristic, wherein at least one of the first characteristic related to the lead vehicle or the one or more remote vehicles, or the change in the first characteristic value, includes a distance between a portion of the lead vehicle and a portion of at least one of the one or more remote vehicles.

2. The system of claim 1, wherein the historical data is received from a database that is one of a memory of a lead communication device, a memory of a remote communication device, a company generated database, a positive vehicle control database, a route database, or a government based database.

3. The system of claim 1, wherein the lead vehicle is not physically coupled to the one or more remote vehicles.

* * * * *